United States Patent [19]

Polsfuss

[11] 4,387,609

[45] Jun. 14, 1983

[54] PLASTIC CORK LIFTER

[76] Inventor: Marvin F. Polsfuss, 676 Silver Ave., San Francisco, Calif. 94134

[21] Appl. No.: 334,632

[22] Filed: Dec. 28, 1981

[51] Int. Cl.[3] ..... B67B 7/02

[52] U.S. Cl. ..... 81/3.36; 81/3.46 A

[58] Field of Search ..... 81/3.46 A, 3.46 R, 3.34, 81/3.36, 3.37

[56] References Cited

U.S. PATENT DOCUMENTS

| | | | |
|---|---|---|---|
| 961,224 | 6/1910 | Fischer | 81/3.36 |
| 1,110,210 | 9/1914 | Kissinger | 81/3.37 |
| 1,250,448 | 12/1917 | Green | 81/3.36 |
| 1,359,629 | 11/1920 | Standish | 81/3.36 |
| 1,556,821 | 10/1925 | Hodge | 81/3.36 |
| 2,014,753 | 9/1935 | Weber | 215/46 |
| 3,722,327 | 3/1973 | Strassel | 81/3.1 R |
| 4,018,110 | 4/1977 | Spriggs | 81/3.1 B |

FOREIGN PATENT DOCUMENTS

| | | | |
|---|---|---|---|
| 1176017 | 8/1964 | Fed. Rep. of Germany . | |
| 1519035 | 2/1968 | France | 81/3.46 A |

*Primary Examiner*—Roscoe V. Parker

*Attorney, Agent, or Firm*—David Pressman

[57] ABSTRACT

A prying device, most useful as a plastic cork lifter, comprises an elongated member (10) having a handle section (12) at one end and a prying section (14) at the other end. The prying section comprises a fork with separated dual tines (16/18) having narrowed inner edges which fit into the groove between the cork (20) and bottle (22), below the head of the cork above the neckband of the bottle. A wire hoop (24) extends out from the prying section. The wire hoop is looped around the top of the bottle, just below the cork. The hoop is springably retracted toward the prying section for storage and for aiding in positioning the dual tines in the groove between the bottle and the cork. The hoop is vertically pivotable at the prying section and is bent by about 90 degrees to form an upright "V" (34) at approximately midway out from the prying section. The bend forms a fulcrum point which rests against the side of the bottle at a location slightly down from the cork so that the handle can be rotated down about the fulcrum point, causing the fork to rotate up and lift the cork by multiplied lever force.

4 Claims, 8 Drawing Figures

FIG. 1A
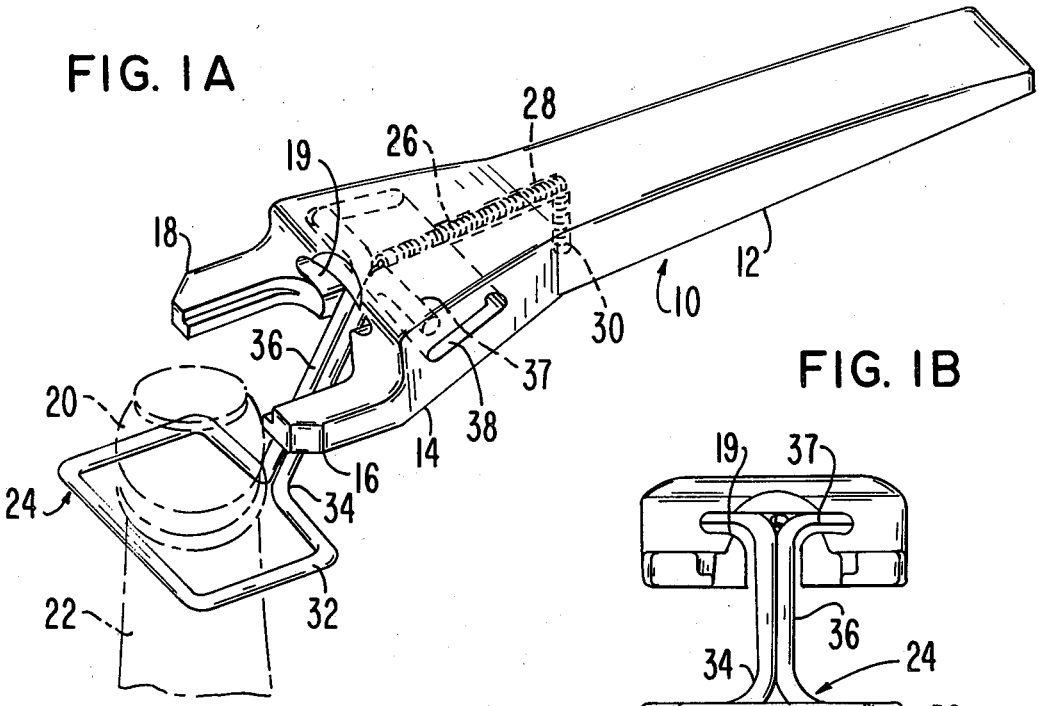
FIG. 1B
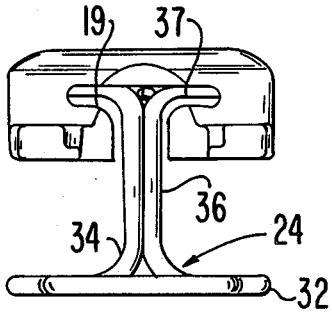
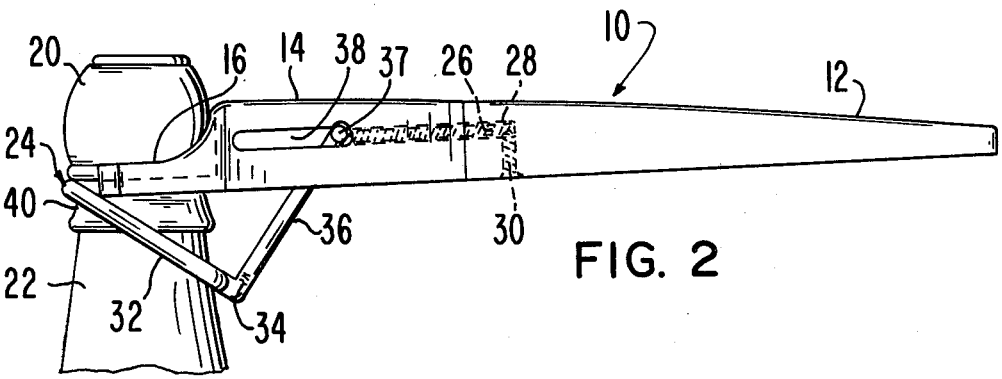
FIG. 2
FIG. 3
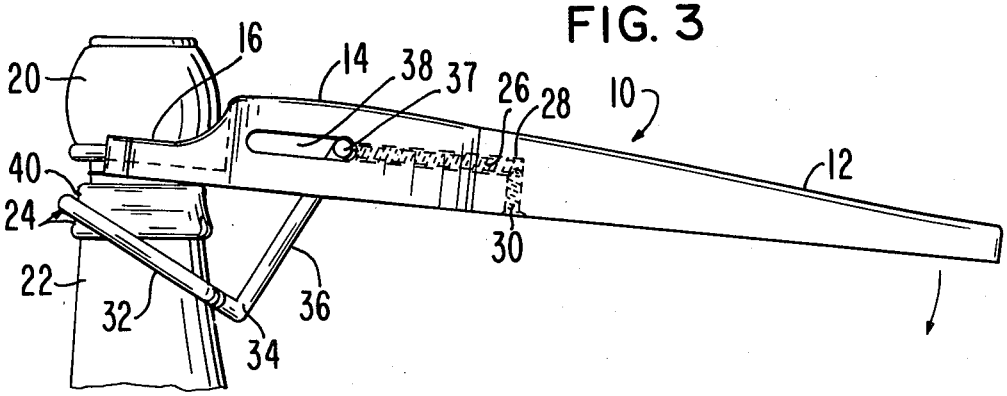

FIG. 4A
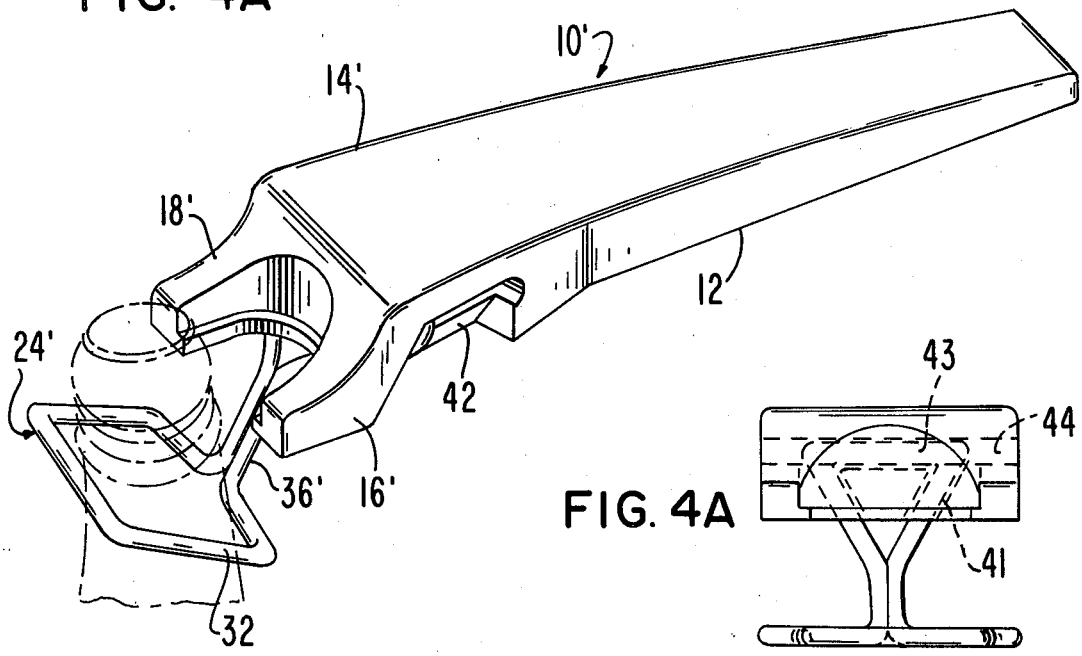
FIG. 4A
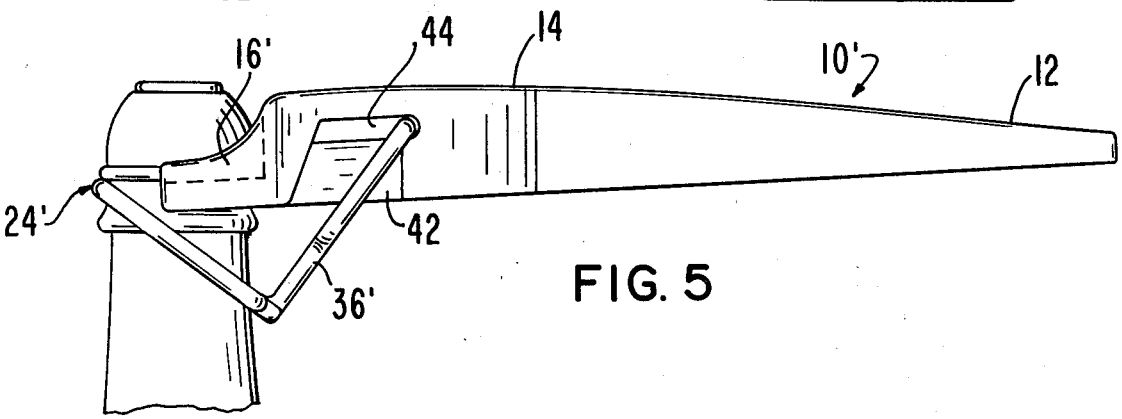
FIG. 5
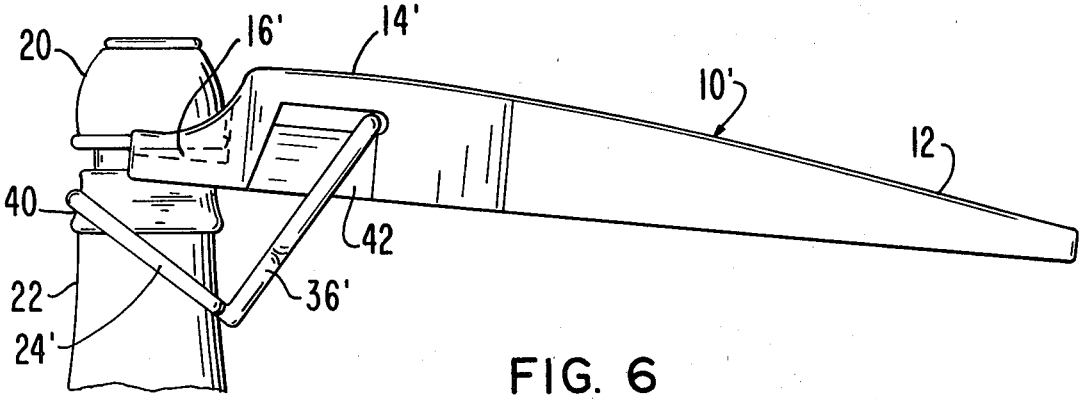
FIG. 6

PLASTIC CORK LIFTER

BACKGROUND—FIELD OF INVENTION

This invention relates to a prying device, particularly to a prying device which may be most advantageously used as a remover of plastic corks on champagne bottles and the like.

BACKGROUND—DESCRIPTION OF PRIOR ART

As is well known, it is difficult to remove plastic corks from champagne bottles. A large amount of force is required and the fact that most plastic corks taper upward only enhances the difficulty, especially for weak, young, and old persons. To alleviate these difficulties, many types of cork removers have been heretofore proposed. However these devices suffered from numerous disadvantages. Some were permanently attached to the bottle, thereby making them "one use" devices which thus were prohibitively expensive and which also made their bottles awkward to store and package. Others were not very efficient, requiring the user to apply a good deal of pressure and awkward manipulation. Still others were very large and cumbersome, while others tended to damage the cork and/or crack or break the bottle. Yet others were inherently expensive, even though reusable.

Accordingly several objects of the present invention are to provide a plastic cork lifter or remover which is efficient, easy to use, reusable, inexpensive, does not damage the cork or the bottle, and which is reliable and convenient. Further objects and advantages will become apparent from a consideration of the ensuing description.

DRAWINGS—DESCRIPTION

FIGS. 1 (A and B) are isometric and end views of a cork lifter according to the invention.

FIG. 2 shows a side view of the lifter in position and about to lift the cork from a bottle.

FIG. 3 shows a view similar to FIG. 2, but wherein the lifter has partially removed the cork from the bottle.

FIGS. 4 (A and B) are isometric and end views of a lifter according to an alternative embodiment of the invention.

FIG. 5 shows a side view of the lifter of FIG. 4 in position about to lift a cork from the bottle and FIG. 6 shows a view similar to FIG. 5, but wherein the lifter has partially removed the cork from the bottle.

FIGS. 1 TO 3—DESCRIPTION

The cork lifter according to the invention, as shown in FIGS. 1 to 3, comprising an elongated member 10 having a handle section 12 and a prying section 14. Prying section 14 comprises a dual-tined fork having separated sturdy tines 16 and 18, the facing edges of which are narrowed for placement in a groove between a cork 20 and its bottle 22. The web area between the tines is removed and open to provide a slot 19.

The prying section also comprises a wire yoke 24 which extends out from prying section 14 but which is springably retracted toward prying section 14 by a spring 26. Spring 26 is held in position in a recess 28 by a set screw 30. Spring 26 is inserted in a hole formed in section 36 of yoke 24, section 36 comprises two straight-wire portions which are welded together, whereafter the hole for spring 26 is bored therethrough.

Wire yoke 24 comprises a hoop portion 32 having a trapezoidal shape, the leftmost side of which (running from upper left to lower right on the paper) is slightly shorter than the opposing side or base which is bent at 34 and which ertends upward and into prying section 14 by means of two adjacent wire sections 36. Wire sections 36 lead into prying section 14 via slot 19. Inside prying section 14, the two opposing wires of the yoke are bent outwardly as at 37 and fit into a pair of side slots, such as 38, in which they can pivot in a vertical plane parallel to the direction of elongation of member 10 and can also translate (slide forward and aft) in slot 38 in the direction of elongation of member 10.

Yoke 24 may be rotated downwardly below member 10 as indicated in FIGS. 1 to 3 or may be rotated up above fork tines 16 and 18 (not shown) such that section 36 of yoke 24 extends in the direction of elongation of member 10 and hoop portion 32 extends perpendicular to member 10 in an upward direction.

Member 10 may be about 17.7 cm (7 in) long and 5 cm (2 in) wide at its widest part from the outer edge of tine 18 to the outer edge of tine 16. In the vertical direction member 10 tapers from about 60 mm (0.25 in) to about 1.9 cm (0.75 in) thick, approximately. Section 36 of yoke 24 may be about 3.8 cm (1.5 in) long and hoop 32 may be about 4.4 cm (1.75 in) wide at its base side (where bend 34 is located) and the opposite side may be about 3.2 cm (1.25 in) long; the trapezoid being about 3.5 cm (1.375 in) high. Member 10 may be formed of aluminum and yoke 24 may be formed of steel having a diameter of 32 mm (0.125 in). Slot 38 is therefore slightly wider than 32 mm and has a widened portion at its end distal from the fork in order to provide a rest detent for yoke 24 when it is fully retracted into member 10.

As best seen in FIGS. 2 and 3, yoke 24, when rotated down below member 10, and viewed from the side, has an upright "V" shape wherein the "V" forms a substantially 90° angle at the level of bend 34. As indicated, above bend 34 the two wires of yoke 24 are adjacent and form a straight portion 36, and at bend 34 they bend outwardly to form the base of hoop 32.

FIGS. 1 TO 3—OPERATION

In operation, if yoke 24 is in its rest position above tines 16 and 18 (not shown), yoke 24 is first pulled out to clear fork tines 16 and 18 and then is rotated so that it extends downwardly from the bottom of the tool, as indicated in FIGS. 1 to 3. Then hoop 32 is positioned over the neck of bottle 22 as indicated in FIG. 1A.

Next, as indicated in FIG. 2, the distal section of hoop 32 is positioned in groove 40 of bottle 22. Member 10 is then pulled back away from bottle 22 and repositioned on the bottle such that tines 16 and 18 are inserted in the groove between cork 20 and the bottle. Now the tool is in position to remove the cork as indicated in FIG. 2. The tool will remain in this position with member 10 extending horizontally without being held since tines 16 and 18 are in the groove between cork 20 and bottle 22 and bend 34 provides a fulcrum point which rests against the side of bottle 22, thereby preventing the tool from falling or rotating downwardly in a clockwise direction.

Next, as shown in FIG. 3, handle section 12 is merely pushed downwardly while the user steadies or holds bottle 22. The tool will rotate about bend or fulcrum point 34. Since the ratio of the length of the tool on the right side of fulcrum 34 is much greater than on the left side thereof, lever action or force multiplication will be provided so that the user will easily be able, by relatively gentle pressure downward on handle section 12, to pry cork 20 upwardly and out of the bottle, as partially indicated in FIG. 3.

Thereafter the tool may be lifted directly off the bottle and yoke 24 may be returned to its home position, above fork 16-18.

It has been found that the tool operates reliably and with great ease and can remove plastic corks rapidly and efficiently without damaging the cork or the bottle; thus cork 20 can be used again if the contents of the bottle are to be preserved.

FIGS. 4 TO 6

An alternative embodiment of the tool is shown in FIGS. 4 to 6. In this embodiment, the tool is operated similarly to the embodiment of FIGS. 1 to 3 but is constructed slightly differently, particularly with regard to yoke 24' and no spring is included.

Specifically the tool of FIGS. 4 to 6 comprises an elongated member 10' having a handle section 12 and a prying section 14'. Fork tines 16' and 18' are shorter and thicker than those of FIGS. 1 to 3, and there is no slot (as in FIG. 1A) between the tines so that the narrowed or constricted portion of the tines is continuous from one tine to the web between the tines and to the other tine.

Hoop portion 32 of yoke 24' is identical to that of FIG. 1. However section 36' of the yoke is only about 1.9 cm (0.75 in) long. Also instead of flaring outwardly as in the tool of FIG. 1A, the upper portions 41 of yoke 24' flare outwardly before entering the tool and then are bent inwardly at 43 to embrace a web portion 42 at the underside of prying section 14'. The ends of yoke 24' ride in a slot 44 above web portion 42.

A retracting spring (together with a spring hole and spring captivating screw) are not required in the embodiment of FIG. 4 since yoke 24' is held more rigidly and with less play than in the embodiment of FIG. 1. Thus the embodiment of FIG. 4A can be made more economically.

As stated, the tool of FIGS. 4 to 6 is operated in identical manner to that of FIGS. 1 to 3, as illustrated in FIGS. 5 to 6, which are similar to FIGS. 2 and 3, respectively.

While the above description contains many specificities, these should not be construed as limitations upon the scope of the invention, but rather as an exemplification of several preferred embodiments thereof. Various other embodiments and ramifications will occur to those skilled in the art. For example, section 36 of yoke 24 can be formed of two separated wires which enter at respective sides of member 10. Other methods of retracting yoke 24 into the tool can be envisioned. The shape of member 10 and its handle sections 12 and 14 can be altered. Also, while described as a cork lifter, the tool can also be used on various other work pieces and prying applications where an elongated member having a recess to be pried open is provided, such as telescoped tubes which must be pried apart. Accordingly the true scope of the invention should be determined by the appended claims and their legal equivalents, rather than by the examples given.

I claim:

1. A prying device comprising an elongated member and a yoke, said elongated member comprising:

a handle section at one end thereof, said handle section being manually-holdable, and a prying section at the other end, said prying section having a narrowed prying edge for insertion in a recess in a workpiece and prying against the opposite walls of said recess to widen same, said prying section also having a slot elongated parallel to the direction of elongation of said member, said yoke comprising:

a rigid hoop of a continuous loop of wire extending out from said prying section of said elongated member and back again to said prying section, said rigid hoop having two free ends positioned in said slot, said free ends of said hoop being pivotable and translatable in said slot such that said wire yoke can pivot in a vertical plane parallel to the direction of elongation of said member, said hoop having an initial section extending out from the free ends thereof and away from said elongated member in a direction oblique to the direction of elongation of said member and away from said handle section, said hoop having a rigid bend at the end of said initial section distal from said prying section, said hoop having a terminal section beyond said bend and oriented such that terminal section and said initial section form a fixed angle when viewed from a direction perpendicular to the direction of elongation of said member, said terminal section also completing said hoop and having two first portions extending in opposite directions from said bend and perpendicular to said initial portion of said hoop, said terminal section of said hoop also having a remainder portion joining said two first portions to complete said hoop, said terminal section being capable of extending from said bend toward said elongated member at an oblique angle and away from said handle section, such that said bend can be braced against said workpiece to serve as a fulcrum when said hoop is placed around said workpiece and said prying section is inserted into said recess in said workpiece, whereby when said prying edge is inserted in said recess in said workpiece and said yoke is looped around said workpiece with said bend of said hoop against said workpiece, said bend will serve as said fulcrum against said workpiece and said handle can be rotated in said vertical plane about said fulcrum and toward said workpiece to cause said prying edge to widen said recess.

2. The device of claim 1 wherein said prying section includes a spring arranged to pull said wire yoke to said prying section such that the free ends of said wire are pulled to the respective ends of said slot proximal to said handle section.

3. The device of claim 1 wherein the opposite segments of said wire yoke extending out from said elongated member and to said bend are positioned adjacent to each other and thereafter extend in opposite directions away from each other to form the initial section of said hoop.

4. The device of claim 3 wherein said adjacent segments of said wire yoke are joined together and have a hole therethrough, said prying section including a spring extending through said hole and arranged to pull said wire yoke to said prying section such that the free ends of said wire are pulled to the respective ends of said slot proximal to said handle section.

* * * * *